US009702646B2

(12) United States Patent
Giaretta

(10) Patent No.: US 9,702,646 B2
(45) Date of Patent: Jul. 11, 2017

(54) BB-SHOT LOADER DEVICE FOR AIR WEAPON CARTRIDGES, CARTRIDGE FOR AIR WEAPONS, LOADER ASSEMBLY AND METHOD OF LOADING BB-SHOT FOR AIR WEAPONS

(71) Applicant: Demis Giaretta, Altavilla Vicentina (IT)

(72) Inventor: Demis Giaretta, Altavilla Vicentina (IT)

( * ) Notice: Subject to any disclaimer, the term of this patent is extended or adjusted under 35 U.S.C. 154(b) by 0 days.

(21) Appl. No.: 15/112,178

(22) PCT Filed: Jan. 21, 2015

(86) PCT No.: PCT/IB2015/050472
§ 371 (c)(1),
(2) Date: Jul. 17, 2016

(87) PCT Pub. No.: WO2015/114493
PCT Pub. Date: Aug. 6, 2015

(65) Prior Publication Data

US 2016/0334187 A1 Nov. 17, 2016

(30) Foreign Application Priority Data

Jan. 31, 2014 (IT) ..... MI2014A0029

(51) Int. Cl.
*F41A 9/83* (2006.01)
*F41B 11/00* (2013.01)
(Continued)

(52) U.S. Cl.
CPC ..... *F41A 9/83* (2013.01); *F41B 11/55* (2013.01); *F41B 11/56* (2013.01); *F41B 11/89* (2013.01); *F42B 39/02* (2013.01)

(58) Field of Classification Search
CPC .. F41A 9/83; F41B 11/50; F41B 11/52; F41B 11/55
(Continued)

(56) References Cited

U.S. PATENT DOCUMENTS 3,263,664 A * 8/1966 Bauer ..... F41A 9/83 124/49
3,831,574 A * 8/1974 Strand ..... F41A 9/83 124/49
(Continued)

FOREIGN PATENT DOCUMENTS

JP 2004309040 11/2004

OTHER PUBLICATIONS

ESA Toivonen: "40 mm BB showers put to a test", Airsoft Soldier, No. 1, Jun. 19, 2008 (Jun. 19, 2008), pp. 22-27, XP055140767, ISSN: 1797-7444 p. 24, left-hand column, line antepenultimate—middle column, line 11; figures Mad Bull 48 BBs, Mad Bull 96 BBs.
(Continued)

*Primary Examiner* — Alexander Niconovich
(74) *Attorney, Agent, or Firm* — Themis Law

(57) ABSTRACT

A loader device for loading BB-shot into a cartridge for air weapons includes a main body with a plurality of channels for housing respective rows of BB-shot balls and at least one holding member for holding the rows of BB-shot balls that have been introduced into the channels. Such loader device includes an elongate container with an open end and a closed end defining a cavity for storing a predetermined amount of BB-shot balls, wherein the open end has a temporary connection element for connection to the body of the cartridge, to provide simultaneous gravity loading of the rows of BB-shot balls into the respective channels of the cartridge.
(Continued)

A cartridge for air weapons. A loader assembly including the loader device and the cartridge. A method of loading BB-shot into air weapons.

8 Claims, 7 Drawing Sheets

(51) Int. Cl.
*F42B 39/02* (2006.01)
*F41B 11/89* (2013.01)
*F41B 11/55* (2013.01)
*F41B 11/56* (2013.01)

(58) Field of Classification Search
USPC ..... 124/41.1, 45, 49, 51.1, 82; 42/87
See application file for complete search history.

(56) References Cited

U.S. PATENT DOCUMENTS 4,020,974 A * 5/1977 Bauer ..... B65D 83/0481 124/50
4,492,051 A * 1/1985 Switzer ..... F41A 9/85 42/87
4,564,125 A * 1/1986 Esslinger ..... F42B 39/002 124/45
4,723,531 A * 2/1988 Hampton ..... F41A 9/83 124/45
4,879,829 A * 11/1989 Miller ..... F41A 9/83 42/87
5,596,167 A * 1/1997 Davis ..... F42B 7/00 102/449
6,234,157 B1 * 5/2001 Parks ..... F41B 11/52 124/45
6,722,355 B1 * 4/2004 Andrews, Jr. ..... F41B 11/52 124/49
7,077,118 B2 * 7/2006 Lewis ..... F41B 11/50 124/45
7,954,480 B2 * 6/2011 Broberg, Jr. ..... F41A 9/01 124/45
8,469,014 B2 * 6/2013 Hu ..... F41A 9/83 124/51.1
9,207,038 B2 * 12/2015 Gilley ..... F41B 11/55
2004/0149275 A1 * 8/2004 Vincent ..... F41B 11/52 124/41.1
2008/0029076 A1 * 2/2008 Liang ..... F41B 11/50 124/51.1
2012/0060810 A1 * 3/2012 Hu ..... F41A 9/83 124/45
2013/0091752 A1 * 4/2013 Ervin ..... F41A 9/375 42/90
2014/0082984 A1 * 3/2014 Kent ..... F41A 9/83 42/88
2015/0013655 A1 * 1/2015 Giaretta ..... F41B 11/62 124/73

OTHER PUBLICATIONS

Anonymous: "Buy MadBull Precision 0.25g Dark Knight Tracer BB 2000rds (Bottle)-BBs & other Airsoft gun accessories at redwolfairsoft.com", Jun. 1, 2010 (Jun. 1, 2010), XP055140773, Retrieved from the Internet: URL:http://web.archive.org/web/20100601062 URL:http://www.redwolfairsoft.com/redwolf/airsoft/BBs_Tools_BBs_MadBull_Precision_0_25g_Dark_Knight_Tracer_BB 2000rds_Bottle.htm [retrieved on Sep. 17, 2014] middle column, paragraph 1; figure right column under product details.

* cited by examiner

BB-SHOT LOADER DEVICE FOR AIR WEAPON CARTRIDGES, CARTRIDGE FOR AIR WEAPONS, LOADER ASSEMBLY AND METHOD OF LOADING BB-SHOT FOR AIR WEAPONS

FIELD OF THE INVENTION

The present invention generally finds application in the field of air weapons, and particularly relates to a loader device for loading BB-shot into a cartridge for air weapons.

The invention further relates to a cartridge for air weapons, as well as a loader assembly and a method of loading BB-shot into air weapons.

BACKGROUND ART

Air weapons are known, which are usually employed in a sport known as airsoft and comprise loader devices, commonly known as grenades or BB-shower, adapted to allow simultaneous ejection of a plurality of BB-shot balls at each shot of the weapon.

Generally, these loader devices comprise a cylindrical body having a front portion with a plurality of radially offset longitudinal channels, which are adapted to contain a predetermined amount of BB-shot balls.

Furthermore, these devices have a chamber for accumulation of pressurized gas and a trigger element for promoting the instantaneous release of gas into the channels and ejection of the BB-shot from the barrel of the weapon.

An elastic holding member is also provided, in a seat formed on the outer surface of the cylindrical body, for preventing unintentional release of the BB-shot from the channels.

Such devices are loaded with BB-shot, before being placed on the weapon, by appropriate manually actuated tools, that are widely used in the art.

For example, JP2004309040 discloses a manual loading tool for loader devices comprising a hollow box-like body for containing BB-shot and an actuator element which is adapted to be actuated by the user to promote the release of a row of BB-shot balls through an outlet.

This tool has a cylindrical end portion defining the outlet and adapted to be introduced with a small clearance into a channel to transfer the BB-shot therein, while preventing any loss of BB-shot during loading.

Likewise, TWM283155 discloses a device having a hollow BB-shot containing body and a manual mechanism for promoting BB-shot release through an outlet.

A first drawback of these arrangements is that these tools promote at each actuation the release of one row of BB-shot balls at a time.

Due to this feature, the loading process of the loader device is particularly long and labor intensive as the device must be manually actuated as many times as there are channels in it, for full loading.

A further drawback is that these tools have poor versatility, as they allow transfer of BB-shot with only one predetermined diameter.

This is because the outlet of the device has a diameter substantially close to that of the cartridge channels, such that its end portion may be inserted therein and a BB-shot ball having a slightly smaller diameter than the channel may be transferred.

Therefore, the user shall be equipped with various types of loader devices, designed to store BB-shot of different sizes, to be transferred into cartridges having channels of different diameters.

Finally, an important drawback is that the relative complexity of these devices may cause jamming of the actuator during cartridge loading, especially when the actuator is actuated may times during a small interval of time. Furthermore, as stated by EsaToivonen on the Airsoft Soldier website, BB-shot cartridges are known, which comprise a cylindrical body having a plurality of channels for housing respective rows of BB-shot balls. Nevertheless, these cartridges are difficult to load, as they are weakly coupled to the loader, which may lead to BB-shot release from the container during loading.

DISCLOSURE OF THE INVENTION

The object of the present invention is to obviate the above drawbacks, by providing a loader device for loading BB-shot into an air weapon cartridge, that is highly efficient and relatively cost-effective.

A particular object of the present invention is to provide a loader device for loading BB-shot into an air weapon cartridge, that affords reduced loading times.

Another object of the present invention is to provide a loader device for loading BB-shot into an air weapon cartridge, that has a simple construction and is very easy to use.

Yet another object of the present invention is to provide a loader device for loading BB-shot into an air weapon cartridge, that has a particularly versatile configuration, and allows loading of BB-shot of different diameters.

Another important object of the present invention is to provide a loader device for loading BB-shot into an air weapon cartridge, that ensures high reliability and ensures full cartridge loading in any condition of use.

These and other objects, as better explained hereafter, are fulfilled by a loader device for loading BB-shot into an air weapon cartridge as described herein.

In a further aspect, the invention relates to a BB-shot cartridge for use with air weapons.

Also, an assembly is provided, which comprises an air weapon cartridge and a loader device as described above.

Finally, in a further aspect the invention relates to a method of loading BB-shot into air weapons.

These features will afford simultaneous and safe loading of cartridge channels with BB-shot, while reducing overall loading times.

Advantageous embodiments of the invention are defined in accordance with the dependent claims.

BRIEF DESCRIPTION OF THE DRAWINGS

Further features and advantages of the invention will become more apparent upon reading of the detailed description of several preferred, non-exclusive embodiments of a loader device for loading BB-shot into an air weapon cartridge, a cartridge, an assembly comprising the loader device and the cartridge, and a method of loading BB-shot into air weapons, which are described as non-limiting examples with the help with the accompanying drawings in which.

DETAILED DESCRIPTION OF A PREFERRED EMBODIMENT

The accompanying figures show a loader device 1 for loading BB-shot P into an air weapon cartridge 2.

Particularly, the air weapon, not shown, may be of the type as used in the sport known as airsoft and may comprise a chamber for removably housing a cartridge 2, which is adapted to allow simultaneous ejection of a plurality of BB-shot balls P upon actuation of the trigger by a user.

Figure 1:
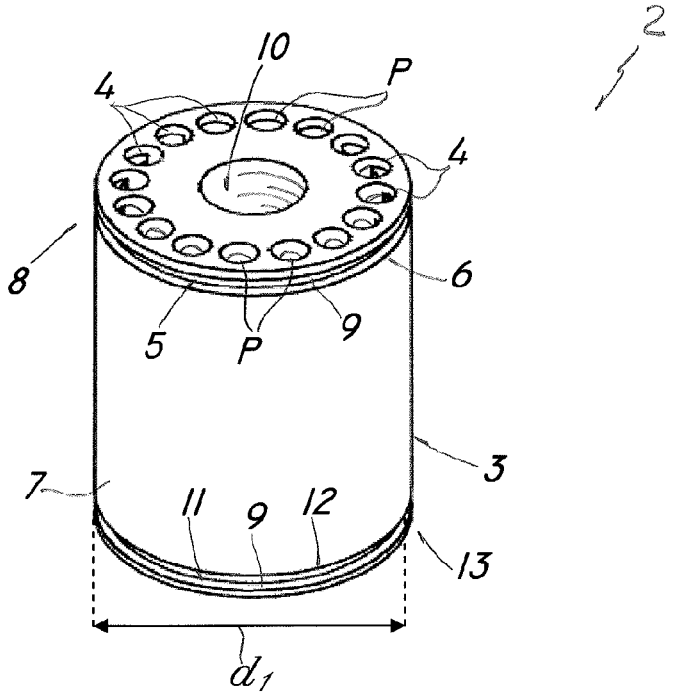
FIG. 1 is a perspective view of a first embodiment of an air weapon cartridge of the invention.
Figure 2:
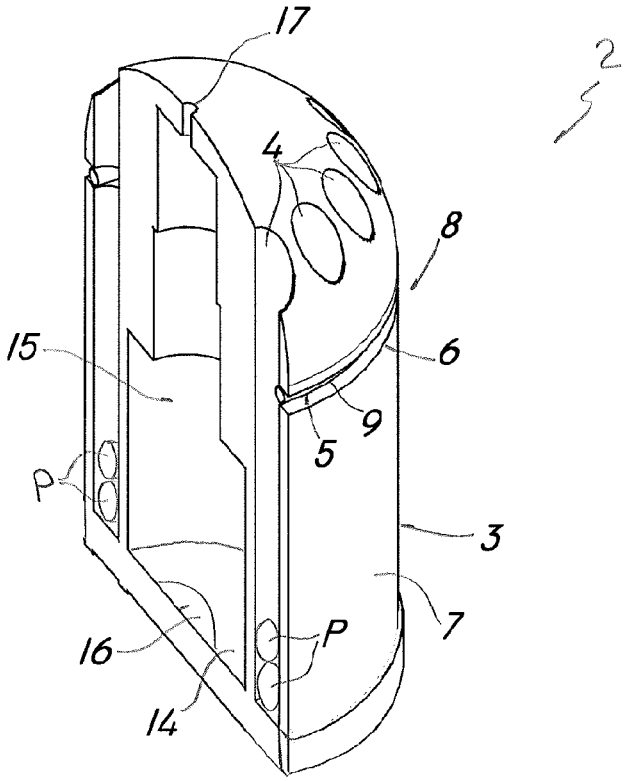
FIG. 2 is a broken-away perspective view of a second embodiment of an air weapon cartridge of the invention.

As best shown in FIGS. 1 and 2, the cartridge 2 comprises a main cylindrical body 3 with a plurality of channels 4 for housing respective rows of BB-shot balls P.

The cylindrical body 3 may have a diameter $d_1$ of about 40 mm, i.e. substantially close to the standard diameter of housing chambers in airsoft weapons.

Preferably, the channels 4 may have such a size as to be able to contain BB-shot having a diameter of 6 mm.

The channels 4 may be of equal diameter and depth and be arranged along a circumference, offset by a constant angular pitch.

Preferably, the cartridge 2 comprises a holding member 5 for holding the rows of BB-shot balls P introduced inserted in the channels 4.

Particularly, as best shown in the particular configuration of the illustrated cartridge 2, the cylindrical body 3 may have an annular seat 6 formed on its outer surface 7 proximate to the upper end 8.

The depth of the annular seat 6 will be appropriately set to allow partial insertion of the holding member 5 into the channels 4.

Conveniently, as shown in FIGS. 1 and 2, the holding member 5 may be of elastic nature and may comprise an O-ring 9 accommodated in the annular seat 6 formed on the outer surface 7 of the cylindrical body 3.

The presence of the O-ring 9 will prevent BB-shot P from coming out of the channels 4 during transport and handling of the cartridge 2 before accommodation thereof into the firing chamber of the weapon.

In a first configuration of the cartridge 2 as shown in FIG. 1, the main cylindrical body 3 comprises a central axial hole 10, which is located proximate to the holding member 5, and has internal threads, and the channels 4 in the cylindrical body 3 may be through channels.

The central hole 10 may also be a through hole and the cartridge 2 may comprise a further holding member 11 accommodated in a further annular seat 12 formed on the outer surface 7 proximate to the the lower end 13 of the central body 3.

The presence of a further holding member 22 will prevent BB-shot P from coming out of the channels 4 at the lower end 13 of the cylindrical body 3.

Alternatively, in the second configuration of the cartridge 2, as best shown in FIG. 2, the channels 4 may be blind channels and the cylindrical body 3 may have a substantially flat bottom wall 14.

The cartridge 2 may comprise an inner chamber 15 for containing a pressurized gas and a trigger element 16, located at the bottom wall 14 and adapted to promote instantaneous release of gas into the channels 4.

Therefore, the cartridge 2 as shown in FIG. 2 is of the self-triggering type because, as the trigger is actuated by a user, it automatically causes a gas hammer effect and hence the ejection of BB-shot from the weapon.

This cartridge 2 also has a central passage 17 having a very small diameter, which is used as a gas escape channel and has no internal threads.

In a further aspect, as best shown in FIGS. 3 to 8, the invention relates to a loader device 1 for loading BB-shot into an air weapon cartridge 2 as described above.

In its basic embodiment, such loader device 1 comprises an elongate container 18 with an open end 19 and a closed end 20 defining a cavity 21 for storing a predetermined amount of BB-shot balls P.

The cavity 21 may have such a size as to contain a large number of BB-shot balls P having a diameter of 6 mm, for loading a plurality of cartridges 2.

Furthermore, the open end 19 of the elongate container 18 has temporary connection means 22 for temporary connection to the body 3 of the cartridge 2, to provide simultaneous gravity loading of the rows of BB-shot balls P into the respective channels 4 of the cartridge 2.

Particularly, the container 18 may have a substantially cylindrical side wall 23 defining a longitudinal axis L.

This side wall 23 may be joined to a substantially flat transverse bottom wall 24 which defines a base for the loader device 1.

Conveniently, the open end 19 may comprise a substantially circular edge 25 whose diameter $d_2$ is slightly greater than the diameter $d_1$ of the cylindrical body 3 of the cartridge 2 to enable partial insertion thereof.

Particularly, this edge 25 may have a diameter $d_2$ substantially close to about 50 mm.

Figure 3:
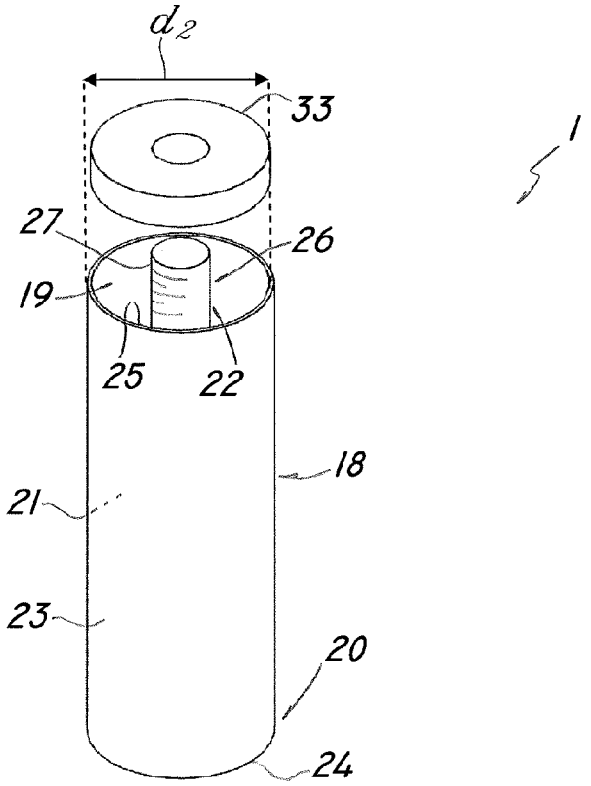
FIGS. 3 and 4 are perspective and broken-away side views respectively of a first embodiment of a loader device of the invention.
Figure 4:
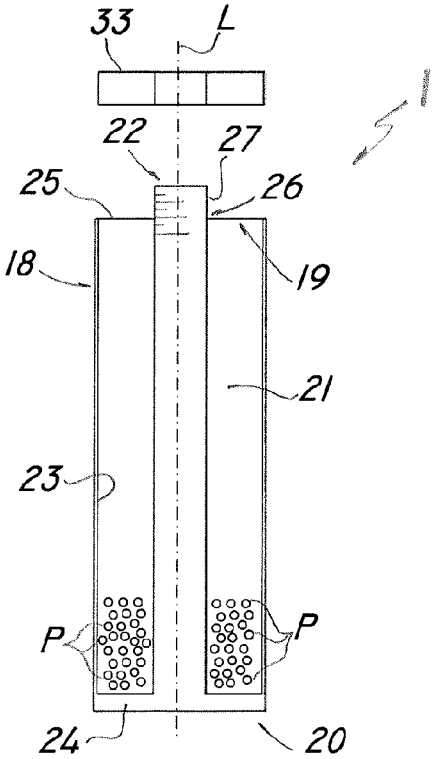
Figure 5:
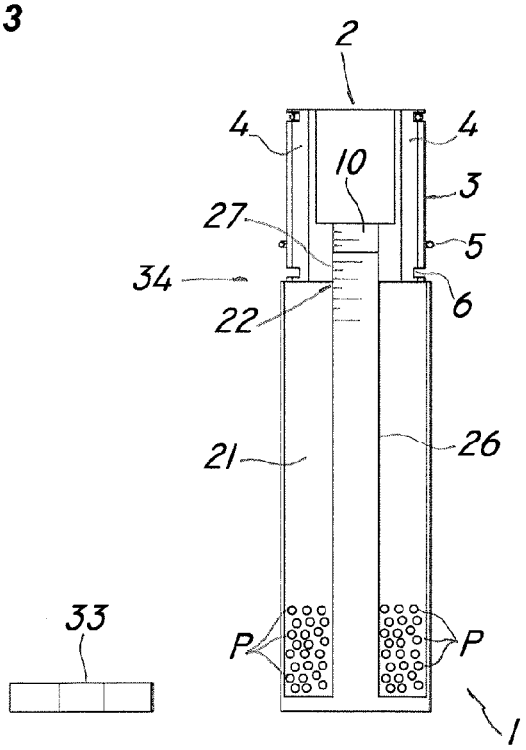
FIG. 5 is a broken-away side view of an assembly comprising the cartridge as shown in FIG. 1 and the loader device as shown in FIGS. 3 and 4.

In a first preferred configuration of the loader device 1 as shown in FIGS. 3 to 5, which is designed for loading a cartridge 2 as shown in FIG. 1, the connection means 22 may comprise a central spindle 26, which is introduced into the cavity 21 and axially extends from the bottom wall 24.

The spindle 26 has a free end 27 projecting out of the open end portion 19 and adapted for removable engagement of the central hole 10 of the cartridge 2.

Preferably, the free end 27 of the spindle 26 may have external threads for screw engagement thereof in the central hole 19 of the cartridge 2, as best shown in FIG. 5.

Figure 6:
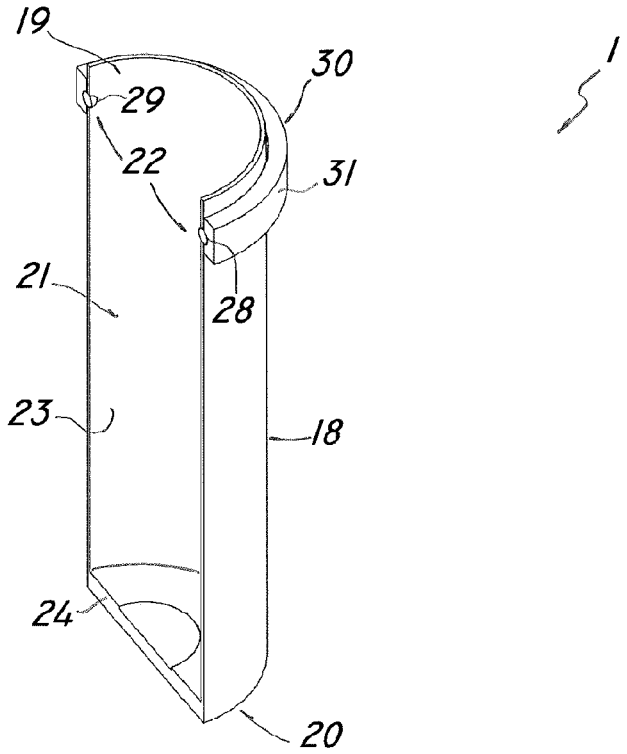
FIGS. 6 and 7 are broken-away perspective and side views respectively of a second embodiment of a loader device of the invention.
Figure 7:
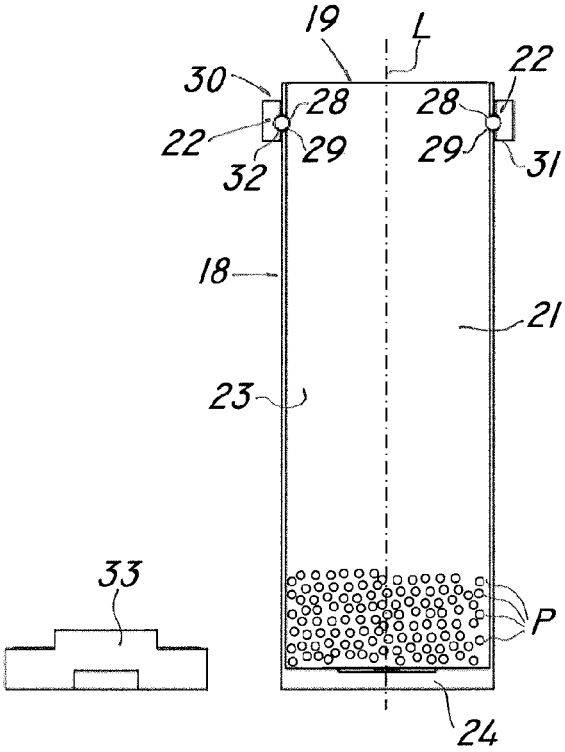
Figure 8:
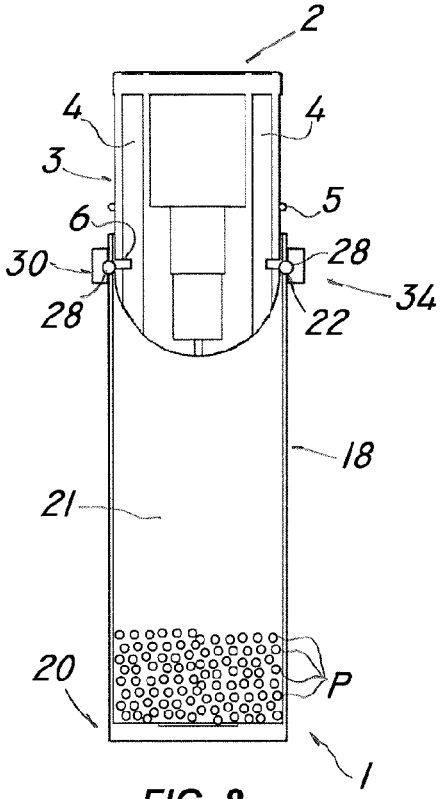
FIG. 8 is a broken-away side view of an assembly comprising the cartridge as shown in FIG. 2 and the loader device as shown in FIGS. 6 and 7.

According to a further preferred configuration of the loader device as shown in FIGS. 6 to 8, which is designed for loading a cartridge 2 as shown in FIG. 2, the temporary connection means 22 may comprise at least one pair of balls 28 located proximate to the edge 25 of the open end 19 of the container 18 and projecting into the cavity 21 through respective holes 29 having a smaller diameter than that of the balls 28.

Furthermore, elastic means 30 may be provided, which act on the balls 28 to push them inwards and removably lock the cartridge 2, as best shown in FIG. 8.

Advantageously, as more clearly shown in the figures, the elastic means 30 may comprise an annular element 31 made of an elastic material, e.g. rubber or the like, having an inner groove 32 for accommodating the balls 28.

The elastic annular element 31 will allow the balls 28 to be retained in the holes 29 formed on the side wall 23 of the container 17, and to be biased toward the interior of the cavity 21 once the cartridge 2 has been inserted through the end opening 19, such that they may interact with the annular seat 6 of the cartridge 2 and promote removable fixation thereof.

Preferably, as more clearly shown in the figures, the loader device 1 may comprise a plug 33 for closing the edge 25 of the open end 19 and prevent release of the BB-shot P when such end is not temporarily connected to the body 3 of the cartridge 2.

In a further aspect, as shown in FIGS. 5 and 8 and 10 to 15, the invention relates to an assembly 34 for loading BB-shot P for use in an air weapon, which comprises a cartridge 2 as shown in FIGS. 1 and 2 and a loader device 1 as described and shown in FIGS. 3, 4, 6 and 7.

Figure 9:
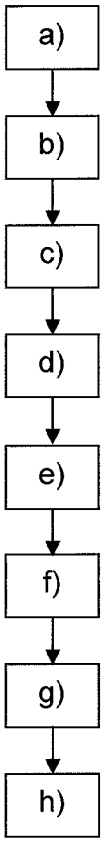
FIG. 9 is a block diagram of the method of loading BB-shot for air weapons according to the invention.

Also, in a further aspect, the invention relaters to a method of loading BB-shot P for air weapons or the like, as schematically shown in the block diagram of FIG. 9, which comprises the step a) of providing a cartridge 2 as shown in FIGS. 1 and 2 having a holding member 5 accommodated in an annular seat 6.

A step b) is also provided, which consists in providing a loader device 1 as shown in FIGS. 3 to 8, containing a sufficient amount of BB-shot balls P to load one or more cartridges 2 and having an open end 19 whose shape is substantially complementary to the shape of the main body 3 of the cartridge 2.

Furthermore, the method comprises the step c) of removing the holding member 5 from its seat 6 on the cartridge 2 and then the step d) of connecting the cartridge 2 to the open end 19 of the loader 1 such that the seat 6 is located proximate to the open end 19.

A step e) is also provided, which consists in having the loader 1 located at the top of the cartridge 2 to promote simultaneous gravity transfer of the BB-shot P into the channels 4 to fill them with rows of BB-shot balls P.

Also, the method comprises the step f) of placing the holding member 5 back into the seat 6 to prevent the BB-shot P loaded in the channels 4 to come out of the latter, and the step g) of having the loader 1 located at the bottom of the cartridge 2.

Finally, a step h) is provided, which consists in removing the cartridge 2 entirely loaded with BB-shot P from the loader 1.

FIGS. 10 to 15 show a plurality of operating steps for loading the cartridge 2 of FIG. 1, that constitute the method as schematically shown in FIG. 9.

Figure 10:
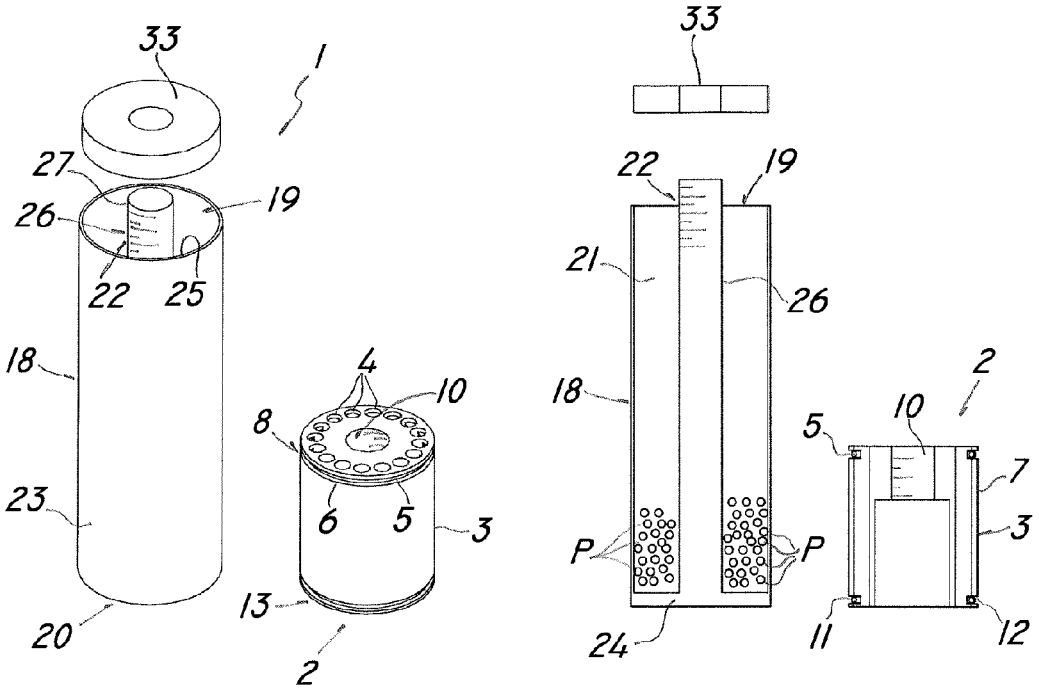
FIGS. 10 to 15 are perspective and broken-away side views of an assembly comprising a cartridge of FIG. 1 and a loader device as shown in FIGS. 3 and 4, in respective BB-shot loading positions.

Particularly, in order to load the cartridge 2, the plug 33 has to be removed from the loader device 1, with the open end 19 facing upwards, as shown in FIG. 10, and the cartridge 2 has to be later positioned such that it is located at the top of the container 18, after removing the holding member 5 from the annular seat 6.

Figure 11:
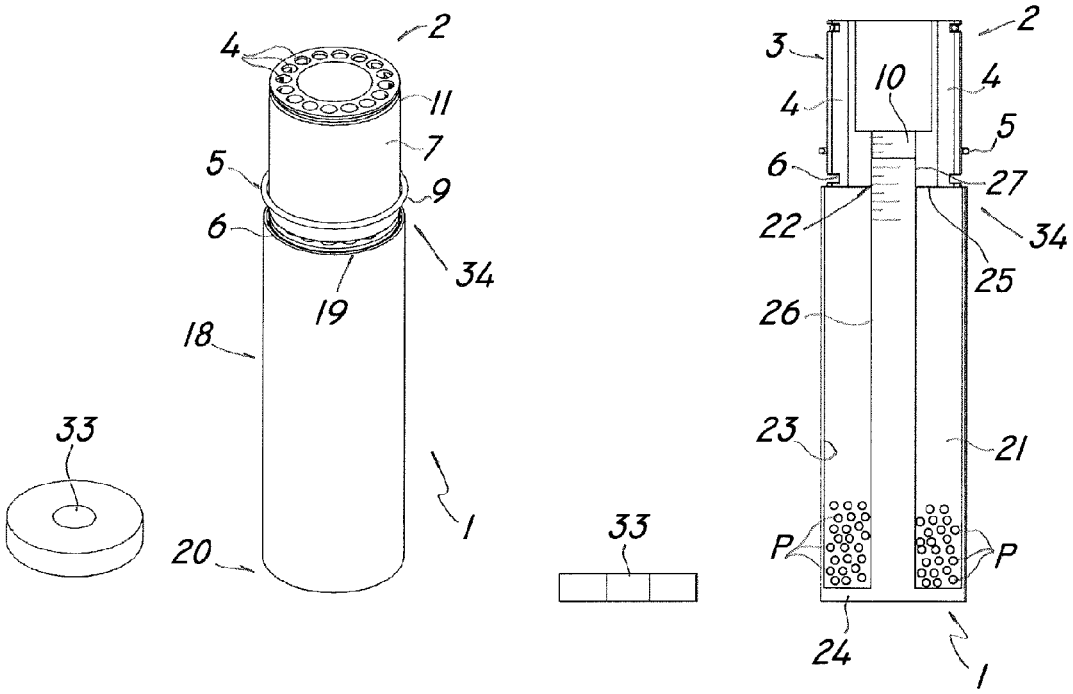

Particularly, as best shown in FIG. 11, the temporary connection of the cartridge 2 to the open end 19 of the container 18 may be promoted by screw engagement of the projecting threaded end 27 of the central spindle 26 with the matingly threaded central hole 10 formed in the cartridge 2.

Figure 12:
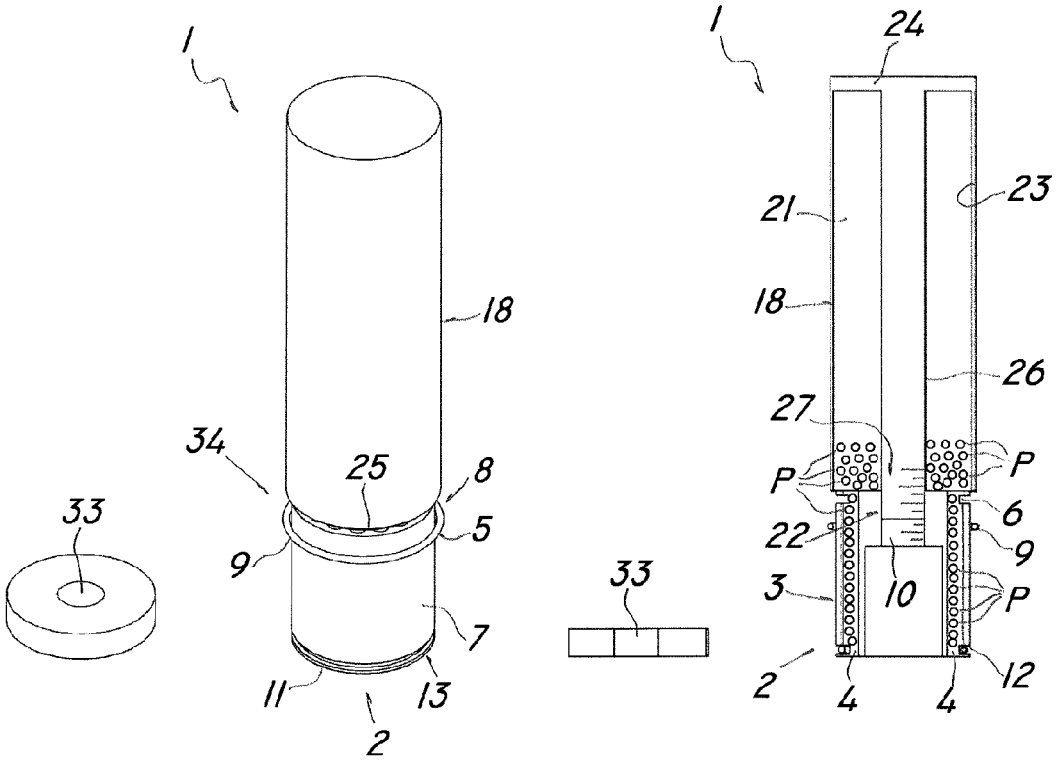

Then, as best shown in FIG. 12, the loader device 1 will be rotated upwards, for the container 18 to be located at the top of the cartridge 2 and for simultaneous gravity transfer of the BB-shot P into all the channels 4 to be promoted.

Figure 13:
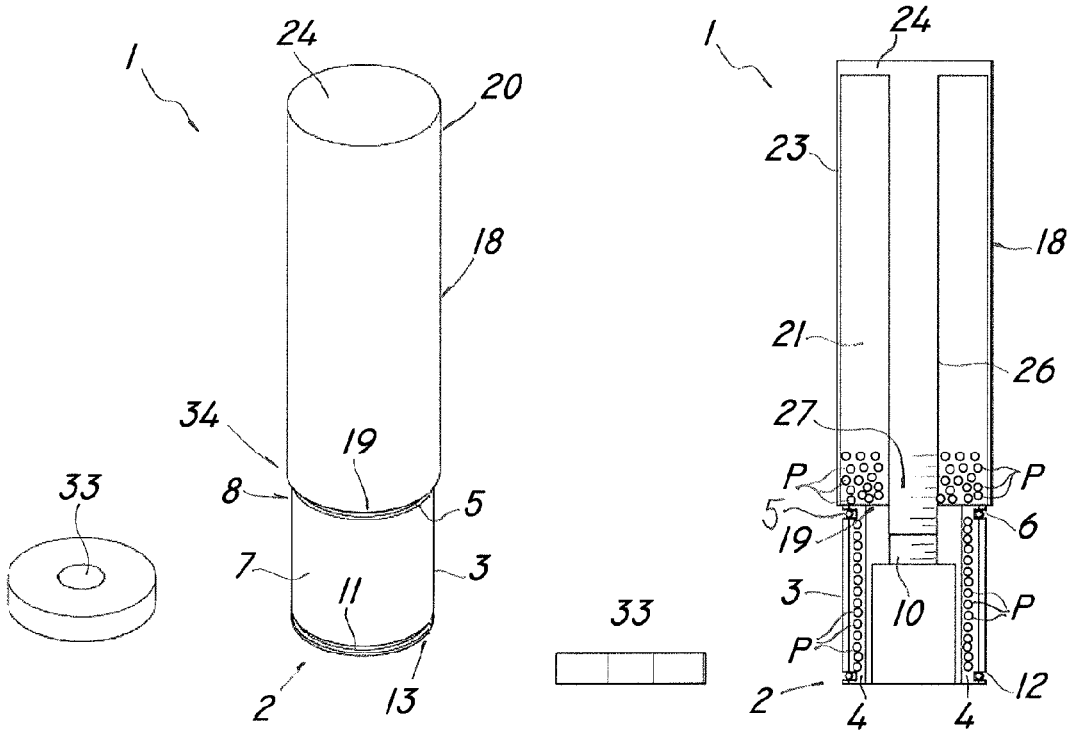
Figure 14:
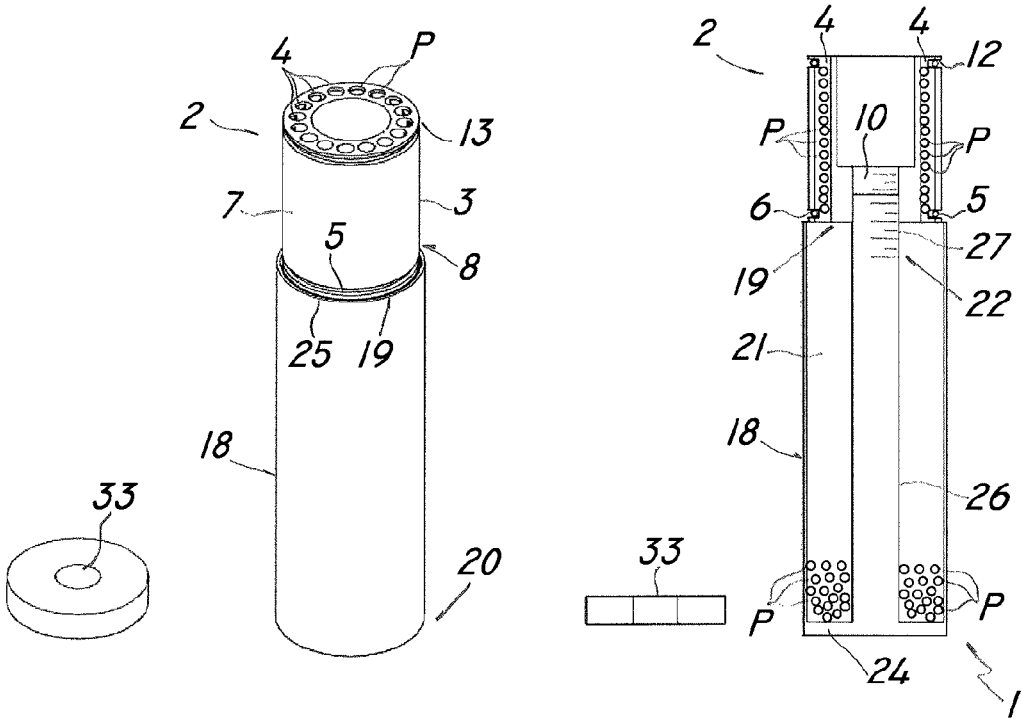

Once the channels 4 are completely filled with BB-shot P, the holding member 5 will be placed back on the corresponding seat 6 formed on the outer seat 7 of the cartridge 2, as clearly shown in FIG. 13, and the loader device 1 will be rotated downwards, for the container 18 to be located at the bottom of the cartridge 2, as shown in FIG. 14.

Figure 15:
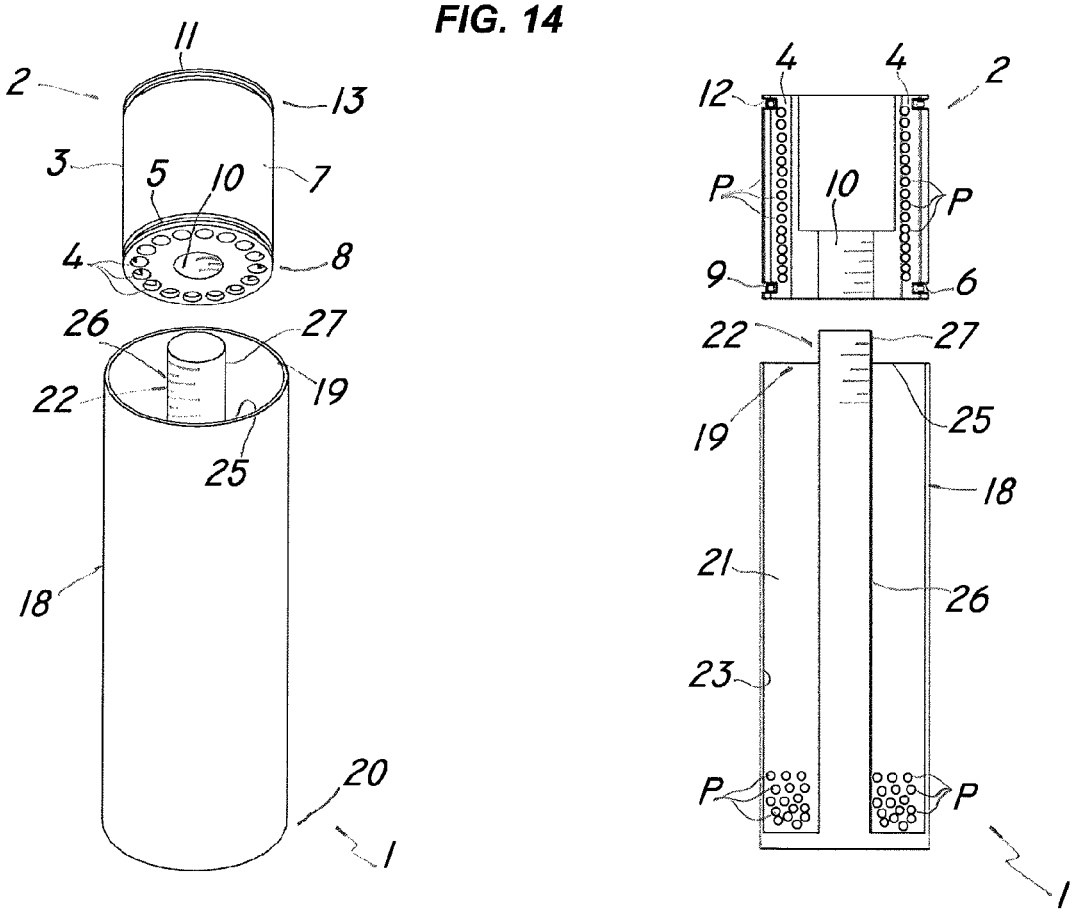

Now the loading procedure may be completed, by removing the loaded cartridge 2 from the open end 19 of the container 18, i.e. by unscrewing the free end 27 of the central spindle 26 from the central hole 10 of the cartridge, as clearly shown in FIG. 15.

Once the cartridge 2 has been removed, the plug 33 may be placed on the open end 19 for closing the container 18 and thus prevent any accidental release of BB-shot P from the loader device 1.

The above disclosure clearly shows that the device 1, the cartridge 2, the assembly 34 and the method of the invention fulfill the intended objects and particularly the object of promoting simultaneous loading of BB-shot P into the channels 4 of the cartridge 2 in a very short time and in a relatively simple manner.

The loader device, the cartridge, the assembly and the method of loading BB-shot in air weapons according to the invention are susceptible to a number of changes or variants, within the inventive concept disclosed in the annexed claims.

All the details thereof may be replaced by other technically equivalent parts, and the materials may vary depending on different needs, without departure from the scope of the invention.

While the device, the cartridge, the assembly and the method of the invention have been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention finds industrial application in the field of weapons, and particularly in the fabrication of a loader device, a cartridge, and a loading assembly for use in air weapons, as well as in the implementation of a method for loading BB-shot for air weapons.

The invention claimed is:

1. A loader device (1) for loading BB-shot into an air weapon cartridge (2), wherein the cartridge (2) comprises a main body (3) with a plurality of channels (4) for housing respective rows of BB-shot balls (P), at least one holding member (5) for holding the rows of BB-shot balls (P) in the channels (4), and a central hole (10) proximate to the holding member (5), the loader device (1) comprising:

an elongate container (18) having an open end (19) and a closed end (20) having a bottom wall (24), said container (18) being adapted to define a cavity (21) for storing a predetermined amount of BB-shot balls (P), wherein said open end (19) houses a temporary connection element (22) to the body (3) of the cartridge (2), wherein said temporary connection element (22) comprises, in said cavity (21), a central spindle (26) which axially extends from said bottom wall (24) and has a free end (27) adapted for removable engagement of the central hole (10) of the cartridge (2), wherein the central spindle (26) has a free end (27) adapted to be removably engaged to the central hole (10) of the cartridge (2), and wherein the open end (19) has a shape that is complementary to a shape of the main body (3) of the cartridge (2) and extends between a circular edge (25) of the container (18) and the central spindle (26) to define an annular open end that is adapted to face the plurality of channels (4) of the cartridge (2) to enable simultaneous gravity loading of the rows of the BB-shot balls (P) into the plurality of channels (4) with the loader device (1) disposed at a top of the cartridge (2) and the spindle (26) engaged to the central hole (10) of the cartridge (2).

2. The loader device as claimed in claim 1, wherein said container (18) has a substantially cylindrical side wall (23) which defines a longitudinal axis (L), and is joined to the bottom wall (24) that is substantially flat.

3. The loader device as claimed in claim 1, wherein the central hole (10) has internal threads, and wherein said free end (27) of said spindle (26) has external threads for screw engagement in the central hole (10) of the cartridge (2).

4. The loader device as claimed in claim 1, wherein said temporary connection element (22) comprises at least one pair of balls (28) located proximate to an edge (25) of the open end (19) of said container (18) and projecting into said cavity (21) through respective holes (29) whose diameter is smaller than a diameter of said balls (28), an elastic member (30) being provided, which acts on said balls (28) to bias said balls inwards and removably lock the cartridge (2).

5. The loader device as claimed in claim 4, wherein said elastic member (30) comprises an annular element (31) made of an elastic material and having an inner groove (32) for accommodating said balls (28) and radially bias said balls inwards.

6. A cartridge (2) for BB-shot (P), for use in air weapons, comprising:

a substantially cylindrical main body (3) with a plurality of channels (4) for housing respective rows of BB-shot balls (P); and at least one holding member (5) for holding the rows of BB-shot balls (P) in the channels (4), wherein said cylindrical body (3) comprises a central axial hole (10) located proximate to said holding member (5), and wherein said central hole (10) is designed for removable engagement with a free end (27) of a central spindle (26) of a loader device (1) comprising:

an elongate container (18) having an open end (19) and a closed end (20) having a bottom wall (24), said container (18) being adapted to define a cavity (21) for storing a predetermined amount of the BB-shot balls (P), wherein said open end (19) houses a temporary connection element (22) to the body (3) of the cartridge (2)

wherein said temporary connection element (22) comprises, in said cavity (21), the central spindle (26) which axially extends from said bottom wall (24) and has a free end (27) adapted for removable engagement of the central hole (10) of the cartridge (2), wherein said central spindle (26) has a free end (27) adapted to be removably engaged to the central hole (10) of the cartridge (2), and wherein the open end (19) has a shape that is complementary to a shape of the main body (3) of the cartridge (2) and extends between a circular edge (25) of the container (18) and the central spindle (26) to define an annular open end that is adapted to face the plurality of channels (4) of the cartridge (2) to enable simultaneous gravity loading of the rows of the BB-shot balls (P) into the plurality of channels (4) with the loader device (1) disposed at a top of the cartridge (2) and the spindle (26) engaged to the central hole (10) of the cartridge (2).

7. The cartridge as claimed in claim 6, wherein said holding member (5) comprises an O-ring (9) which is housed in an annular seat (6) formed on an outer surface (7) of said cylindrical body (3).

8. A method of loading BB-shot (P) for air weapons comprising the steps of:

a) providing a cartridge (2) comprising, a substantially cylindrical main body (3) with a plurality of channels (4) for housing respective rows of BB-shot balls (P), and at least one holding member (5) for holding the rows of BB-shot balls (P) in the channels (4), wherein said cylindrical body (3) comprises a central axial hole (10) located proximate to said holding member (5), and wherein said central hole (10) is designed for removable engagement with a free end (27) of a central spindle (26) of a loader device (1), wherein said holding member (5) is housed in an annular seat (6);

b) providing a loader device (1) comprising, an elongate container (18) having an open end (19) and a closed end (20) having a bottom wall (24), said container (18) being adapted to define a cavity (21) for storing a predetermined amount of the BB-shot balls (P), wherein said open end (19) houses a temporary connection element (22) to the body (3) of the cartridge (2), to provide simultaneous gravity loading of the rows of the BB-shot balls (P) into the respective channels (4) of the cartridge (2), and wherein said temporary connection element (22) comprises, in said cavity (21), the central spindle (26) which axially extends from said bottom wall (24) and has a free end (27) adapted for removable engagement of the central hole (10) of the cartridge (2), said loader containing the predetermined amount of the BB-shot balls (P) to load one or more cartridges (2) and having said open end (19) whose shape is substantially complementary to a shape of the main body (3) of the cartridge (2);

c) removing said holding member (5) from a respective seat (6) thereof on said cartridge (2);

d) connecting said cartridge (2) to the open end (19) of said loader (1) such that said seat (6) is located proximate to said open end (19);

e) having the loader (1) located at a top of the cartridge (2) to promote simultaneous gravity transfer of the BB-shot (P) into said channels (4) to completely fill said channels with rows of BB-shot balls (P);

f) placing said holding member (5) back into said seat (6) to prevent the BB-shot (P) loaded in the channels (4) to come out of the channels;

g) having the loader (1) located at a bottom of the cartridge (2); and h) removing said cartridge (2) fully loaded with BB-shot (P) from said loader (1).

* * * * *